United States Patent [19]

DeLime, III

[11] 3,978,461

[45] Aug. 31, 1976

[54] THREE WIRE DETECTION CIRCUIT

[75] Inventor: Thomas L. DeLime, III, Parsipanny-Troy Hills, N.J.

[73] Assignee: Firetek Corporation, Clifton, N.J.

[22] Filed: May 12, 1975

[21] Appl. No.: 576,511

[52] U.S. Cl. ..... 340/227 R; 340/409; 340/248 A; 324/51

[51] Int. Cl.[2] ..... G08B 17/06

[58] Field of Search ..... 340/409, 176, 227 R, 340/227.1, 228 R, 213 R, 248 R, 248 A; 324/51

[56] References Cited

UNITED STATES PATENTS

| | | | |
|---|---|---|---|
| 3,603,949 | 9/1971 | Walthard | 340/409 |
| 3,676,877 | 7/1972 | Kobayashi | 340/176 X |

*Primary Examiner*—John W. Caldwell
*Assistant Examiner*—William M. Wannisky
*Attorney, Agent, or Firm*—James J. Cannon, Jr.; James J. Cannon

[57] ABSTRACT

A three wire circuit for supplying electrical power to active, power-consuming detection devices and communicating electrical signals providing supervisory information and fire alarm information to a control panel. Two wires supply electrical power the third carrying supervisory and alarm signals. Passive non-power-consuming detectors may also be utilized on said circuit. Detection devices switch the positive power to the signal wire in the event of an alarm and an end-of-line device switches the negative power to the signal wire through a current limiting device as a supervisory signal when conditions are normal. The end-of-line device measures the voltage on the power supply wires and opens its switch when the voltage falls below a specific level to indicate trouble. The circuit can carry an alarm signal in spite of and overriding a supervisory signal.

9 Claims, 6 Drawing Figures

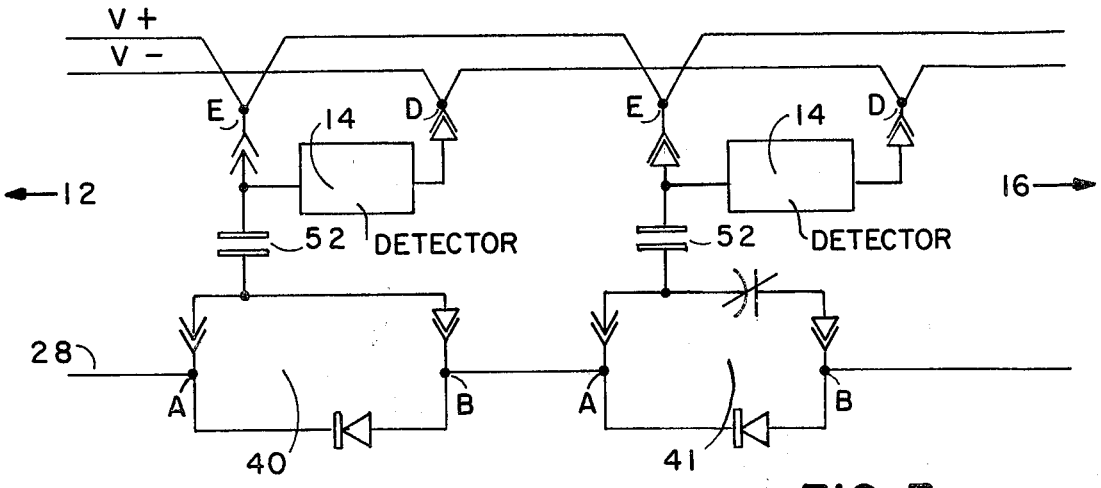
FIG. 3
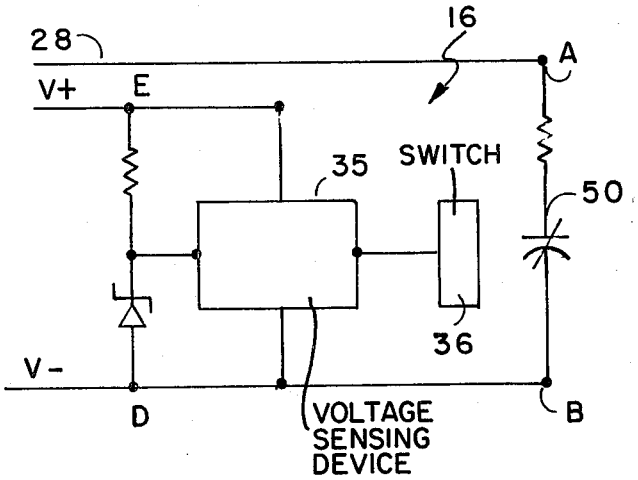
FIG. 4
FIG. 5
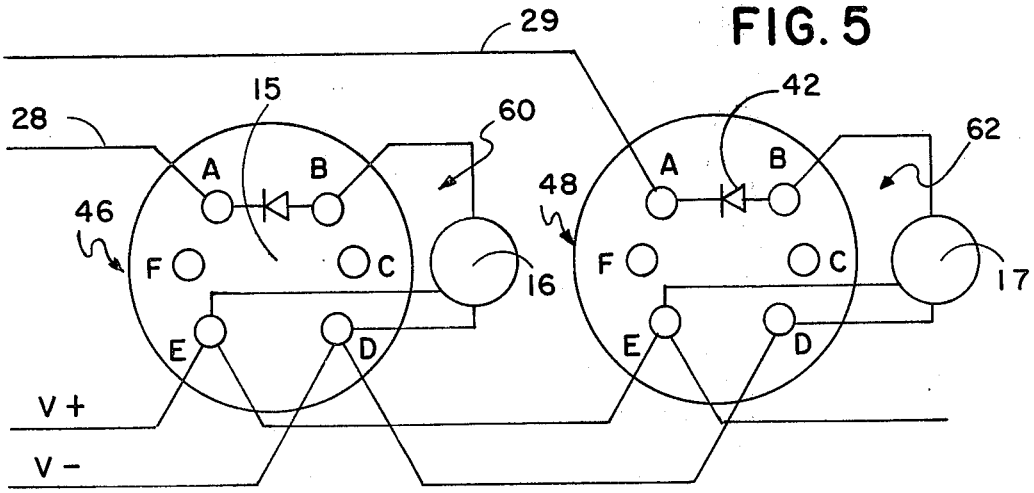

THREE WIRE DETECTION CIRCUIT

BACKGROUND OF THE INVENTION

1. Field of the Invention:

This invention pertains to electrical circuits for use with detection devices and, in particular, to circuits which provide electrical power to active, power-consuming detection devices and which return supervisory or trouble signals as well as alarm signals to the control panel of a detection and alarm system.

2. Description of the Prior Art:

Detection and alarm systems presently available in the prior art use one of two basic electrical circuits depending on the type of detection devices used in the system. Systems using passive or thermal detection devices utilize a two wire circuit loop for providing alarm signals to a control panel. Thermal detection devices are normally passive devices which include an electrical switch in a normally open position. In such devices provision is often made for a limited flow of current to provide for supervision of the continuity and the presence of devices in the loop. The presence of heat closes a switch, thereby increasing the flow of current and sending an alarm signal to the control panel.

In the present state of the art, systems utilizing active, power-consuming detection devices or combinations of active and passive devices require a four-wire circuit, two wires being used to supply electrical power to the detection devices and two wires being used for supervisory or trouble signals and alarm signals.

The circuit of the present invention provides a three wire circuit which accomodates active or passive detection devices, or combinations thereof, and furnishes both supervisory or trouble signals as well as alarm signals to the control panel. Thus it uses one less wire than normal, simplifying installation and reducing costs while maintaining an improved system performance because the control unit may easily distinguish the power being used to operate the detectors from the power used to operate the alarm system.

SUMMARY OF THE INVENTION

This invention pertains to a novel three wire circuit for use in detection and alarm systems, such as fire detection systems, flame detection systems, combustible gas detection systems and other similar systems. This circuit permits the use of active, power-consuming detection devices as well as passive, non-power consuming devices on a single circuit loop and enables both electrical power to be furnished to the active devices and supervisory or trouble signals and alarm signals to be communicated to a control panel. The circuit may be operated from any electrical power supply, AC or DC, which may be available through power supplies.

In the preferred embodiment a positive and negative wire are each connected to the positive and negative terminals respectively of the power supply. Each active detector in the system is a plug-in device having from three to six pins which plug into corresponding pin receptacle terminals in a socket. Each of the three wires is connected to a corresponding terminal of each socket in the system forming a series loop. Each wire in the circuit terminates at the last socket in the series in which an active end-of-line device is inserted. The positive and negative wires of the circuit are used to provide electrical power to the detection devices, signal lamps, and auxilliary devices on the loop. The wires terminate at the end-of-line device. The third wire is used as a line for transmitting signals to the control panel. This wire also runs from the control panel to the end-of-line device, via each detector socket on the circuit loop, in interrupted segments. However, within each detector socket the signal wire segments are connected to each of the two pin receptacle terminals and are bridged together by a shunting strap or supervisory relay between the two corresponding pins.

The active end-of-line device uses a solid state switching circuit which senses the voltage on the positive and negative wires, and requires that the voltage be at a particular level suitable for normal operation of the detectors. If a normal condition exists, the end-of-line device connects the negative supply through a resistor to the third or signal wire. Thus, the signal wire is nominally held down to about the negative voltage level. When the control panel detects that the signal line is at the negative voltage level, it senses that the circuit of all three wires is intact through to the last device, the end-of-line device; i.e., that each detector along the loop has received sufficient voltage, and that no alarm has been transmitted. Otherwise, voltage measured on the signal wire at the control panel would not be near the negative level. Should a supervisory relay-equipped detector device malfunction or be removed from its socket, or should a shunting strap equipped device be removed from its socket, the signal wire circuit is interrupted. The end-of-line device will open its switch, causing the signal line to float and return no voltage to the measuring device at the control panel, thus registering a trouble signal. Each socket is equipped with a reverse-biased diode paralleling the supervisory relay or shunting strap in the detector device. In the event that a relay opens or a shunting strap is removed from the socket, these diodes do not permit the negative voltage to pass through them thus indicating a trouble signal at the control panel.

The output stage of each detector unit contains a normally open switch which, upon detection, closes the switch between the positive line pin and the signal line pin. This switching effects a change of voltage polarity on the signal line, which is detected at the control panel as an alarm signal. Such a change in polarity can be transmitted back to the control panel even if intermediate detectors are disabled, removed or have a supervisory relay open, because the reverse-bised diodes, with respect to a negative voltage, become forward biased, with respect to a positive voltage, thereby conducting the alarm signal to the control panel, while not interferring with a persistent trouble signal.

Optional signal lamps and other accessories may be connected to any detector socket to provide additional indications of the status of the detector apart from the control panel. These accessories can consume substantial power derived from the power supply lines without interferring with the operation of other devices up to the capability of the power supply.

To summarize, the circuit indicates the status of a detection loop using active, power-consuming detectors. The control panel monitors the loop by checking the voltage on the signal wire. If each detector connected to the circuit is both in position in its socket and/or operating normally, then the negative wire will be bridged to the signal wire through a resistor in the end-of-line device. This supervisory signal is carried on the signal line via shunting strap bridges or supervisory relays between two pins of each detector. If a voltage at or near the negative level is detected on the signal wire by the voltage measuring device at the control panel, then the user of the system knows all detectors and the end-of-line device are in place and/or functioning normally and that no alarm has occurred. If no voltage is detected on the signal line at the control panel, the user knows that at least one detector or the end-of-line device is either missing from its socket or malfunctioning or that one of the three wires is broken. This lack of voltage on the signal wire at the control panel constitutes a trouble signal.

The detection of a voltage on the signal wire at the control panel at or near the positive level constitutes an alarm signal. Upon detection of abnormal conditions a detector will bridge the positive wire terminal to the signal wire terminal of the socket through a switch in its output stage which, when closed, bridges its positive pin to its signal pin. Since the signal wire includes reverse-biased diodes, this alarm signal can be transmitted back to the control panel even if an intermediate detector is missing or a supervisory relay is open.

Non-powered, passive detectors and hand-operated pull-stations, or any other device with a normally open switch, may also be utilized within the three wire loop while maintaining the functional integrity of the three wire loop as long as these devices are placed between the control panel the end-of-line device. Any detector can be used, as long as its output stage is wired to perform the switching function described above. Relays may also be used in the system as accessory devices.

The three wire loop disclosed herein is also adaptable to a checkerboard type, cross-zoning alarm installation in which detectors are positioned alternately on two circuit loops. One detector on each circuit loop must be in an alarm condition for the system to initiate such action as discharging an extinguishing system. This requires only four wires, two of which are terminated with an end-of-line device; i.e., each loop must be terminated with an end-of-line device as described above.

BRIEF DESCRIPTION OF THE DRAWINGS

FIG. 3 is a schematic drawing of the output stage circuitry of FIG. 1 incorporating the shunting device and supervisory relay device.

FIG. 4 is a schematic diagram of the end-of-line device as incorporated into the circuit of FIG. 1.

FIG. 5 is a partial schematic diagram of a 4 wire cross-zoned system utilizing the circuit of the present invention.

DESCRIPTION OF THE PREFERRED EMBODIMENT

Figure 1:
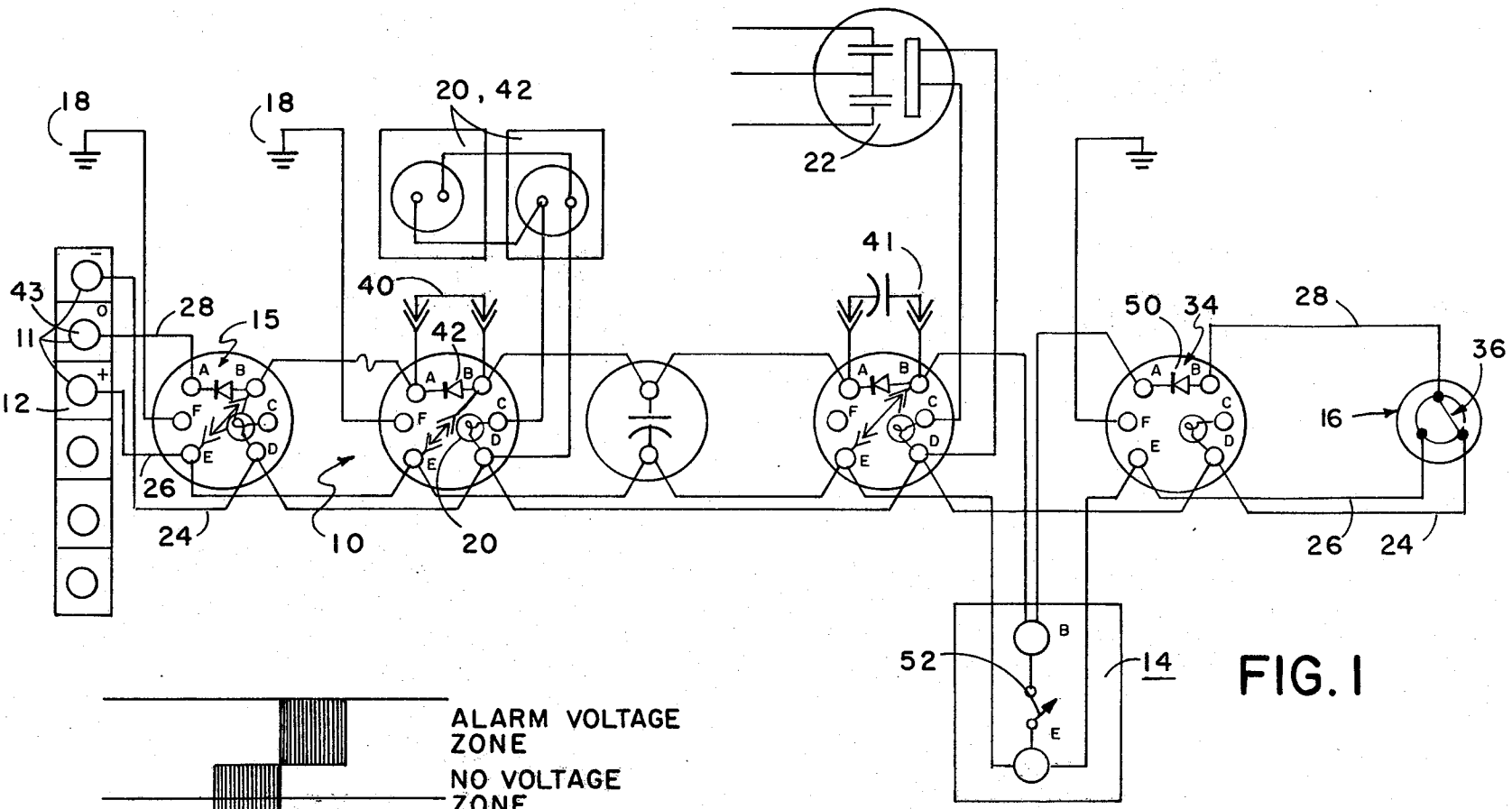
FIG. 1 is a schematic drawing of the three wire detection circuit of the present invention.

Referring now to the drawings, and in particular to FIG. 1, the reference numeral 10 refers to the three wire circuit of the present invention. Each wire of circuit 10 is connected to terminals 11 at control panel 12, is connected to detectors 14 (illustrated in FIG. 2), and is connected to end-of-line device 16 through receptacle terminals 13 of sockets 15. Circuit 10 may optionally include an electrical ground 18, auxiliary lamp 20, auxiliary relays 22, and passive detectors (not shown).

Thus circuit 10 comprises a three wire electrical single circuit loop which connects a plurality of fire or combustion detection devices 14 through sockets 15 to control panel 12 of alarm system. Circuit 10 begins at control panel 12 and includes three wires designated 24, 26, 28 and denominated hereinafter as V-minus 24, V-plus 26 and signal 28. At control panel 12 V-minus 24 and V-plus 26 wires are connected respectively, to the minus and plus terminals 11 of an electrical power supply not shown. Normally, the power supply is furnished by a public utility. In the event of an emergency, an alternate AC or DC power supply may be utilized.

Each detector 14 is an active, power-consuming device containing in its housing 30 a means to detect and indicate electrically the presence or absence, through a variety of techniques, of heat, particles of combustion, or gases, for example.

Figure 2:
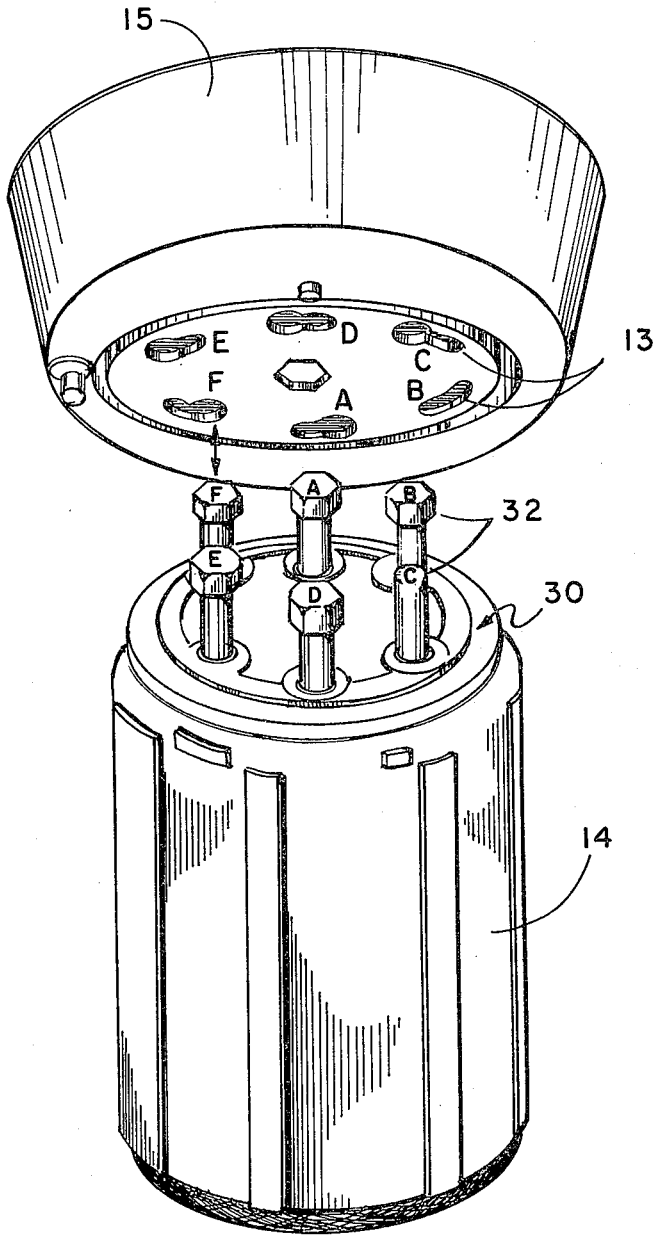
FIG. 2 is a perspective view of a typical active detector being removed from a typical socket of the present invention.

In the preferred embodiment, each detector 14 is built within an individual plug-in housing 30 having three to six pins 32, being the output stage, which plug into a socket 15 having corresponding receptacles 13 for pins 32. (These Figures illustrate a six-pin embodiment.) Circuit 10 links the appropriate pin receptacle terminal 13 to control panel 12 and to the power supply to complete an electrical circuit 10 as described hereinafter. At the end of circuit loop 10 is end-of-line device 16 which plugs into socket 34, which is similar to all other sockets 15 as illustrated in FIG. 2. It should be understood that the combination of a socket 15 and any plug-in-type detector 14 may be replaced by a single wired unit if desired.

The three wires of circuit 10 are connected to the terminals of sockets 15 as follows. V-minus wire 24, connecting to minus terminal 11 of the power supply at control panel 12, runs to terminal D of each socket 15 in circuit 10 and terminates at terminal D of the last socket 34 for end-of-line device 16, in which device, V-minus wire 24 is connected to a voltage comparator 35 including a solid state switching device 36 of which an extended circuit diagram is illustrated. Voltage comparator 35 and related switch are an integral portion of end-of-line device 16, as illustrated schematically in FIG. 4 and are inserted into socket 34. V-plus wire 26, connecting to plus terminal 11 of the power supply at control panel 12, runs to terminal E of each socket 15 and terminates at terminal E of socket 34, where it is connected to the same solid state switching device 36 as V-minus wire 24.

Signal wire 28 is comprised of interrupted segments, the first segment of which begins at a terminal 11 of control panel 12 and runs to the terminal A of the first socket 15 in the series. The next segment runs from the terminal B of the first socket 15 to the terminal A of the next socket 15 in a series and so on, terminating at terminal A of socket 34. The circuit of signal wire 28 for a negative voltage, found during normal power operative condition, is completed by shorting strap 40 or supervisory relay 41 on detector 14 between terminal pins A and B. The circuit of signal wire 28 is completed for a positive voltage, showing abnormal conditions, by a reverse-biased diode 42 linking the terminal A to terminal B within each socket 15, and including socket 34.

End-of-line device 16 contains a voltage sensing device 35 and a solid state switching device 36 to which V-minus 24 and V-plus 26 wires are connected as illustrated in FIGS. 1 and 4. End-of-line device 16 requires power to be present on both conductors 24, 26 and, if power is present, it switches the V-minus wire 24 to signal wire 28 through bridge 50 to terminal A of socket 34. If the power is not present on both conductors 24, 26 end-of-line device 16 effectively interrupts signal line 28.

Ground wires 18 are attached to the terminal F of each socket 15. Optional signal lamp 20 may be included in each detector 14 by wiring between terminals C and D. An additional optional remote signal lamp 42 may be wired in a similar fashion.

For purposes of circuit 10, the details of operation of each detector 14 are not relevant. However, each detector 14, in order to operate in circuit 10, must have an output stage which performs two functions as illustrated in FIG. 3. It must bridge the interrupted segments of signal wire 28 with a shunting strap 40 or supervisory relay 41 such that when detector 14 is in the socket 15, functioning normally, and in the absence of abnormal conditions, V-minus wire 24 will be bridged to signal wire 28 via end-of-line device 16 and via shuting strap 40 or supervisory relay 41 between terminal pin A and pin B. at each socket 15 in circuit 10. Furthermore, the output stage of each detector 14 must have a normally open switch 52 between terminal pins E and B which close upon the detection of abnormal conditions; thus connecting V-plus wire 26 to signal wire 28. This switching effects a change of voltage polarity on signal wire 28 which is detected at control panel 12 as an alarm signal. Such a polarity change can be transmitted back to control panel 12 even if intermediate detectors 14 are disabled, because the previously reverse-biased diodes become forward biased when carrying positive voltage, thereby conducting the alarm signal to control panel 12 over signal line 28.

Circuit 10 at control panel 12 contains a voltage measuring device 43 which compares the voltage on signal wire 28 to the voltage on V-minus 24 and V-plus 26 wires.

Figure 6:
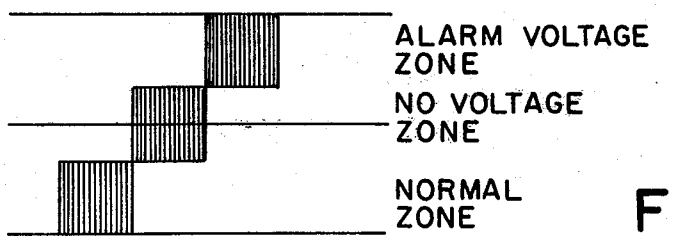
FIG. 6 is a diagrammatic illustration of the variations in current on the signal wire as read at the control panel.

In operation, electrical power is supplied to V-minus and V-plus wires 24, 26 to operate the active, power-consuming detectors 14. In end-of-line device 16 V-minus wire 24 and the V-plus wire 26 are connected to solid state switching device 36 which, if power is present on both conductors, will bridge V-minus wire 24 to signal wire 28. Note that reverse-biased diode 42 in each socket 15 does not permit a negative voltage to pass to complete the signal wire 28 loop. Then, if a negative voltage is to pass over signal wire 28, terminal pin B must be shorted to terminal pin A by shunting strap 40 or by supervisory relay 41 in the output stage of each detector 14. Hence, when detector 14 is plugged into a socket 15, and functioning normally, signal wire 28 loop is unbroken. Terminal pin B of each detector and terminal B of each successive socket 15 is then shorted to terminal pin A and terminal A leading to the signal wire terminal 11 at control panel 12. Hence, if all detectors 14 and end-of-line device 16 are in operable position and functioning normally, and if there is no indication of the presence of abnormal conditions, the voltage detected on signal wire 28 at control panel 12 should be at or near the V-minus level. If any detector 14 is inoperable, and therefore not consuming power, or is removed from its socket 15, in either case breaking the signal wire 28 loop, no voltage would be detected at control panel 12 on signal wire 28. This is an indication of trouble within the detection system, hence designated a supervisory signal as illustrated in FIG. 6.

If evidence of abnormal conditions is detected by any detector 14 in circuit 10, the normally open output stage switch 52 of said detector 14 bridges terminal pin E to terminal pin B, which has the effect of changing the polarity of the voltage on signal wire 28 by connecting V-plus wire 26 to signal wire 28. This causes a voltage reading at the control panel 12 at or near the V-plus level on the signal wire 28, and is an alarm signal. Reverse-biased diodes 42 then are capable of transmitting said voltage to control panel 12.

Passive detectors which do not consume power, may be interspersed at any position on the three wire circuit 10 without destroying the integrity of the system and, if they have a compatible output stage, may also use standard socket 15. It should be understood however, that end-of-line device 16 must be the last device on circuit 10 loop to preserve the integrity of the three wire circuit 10, in that end-of-line device 16 provides the supervisory power check on circuit 10 to insure that all detectors, active or passive, are receiving power. Such passive detectors include thermally operated heat detectors which close a switch upon detection of heat of a certain temperature.

Also hand operated pull-type alarm boxes can be similarly interspersed in circuit 10 before end-of-line device 16.

FIG. 5 illustrates a fragmentary portion of a cross-zoned detection system in which active detectors 46 and sockets 15 are on one three wire circuit loop 60, and active detectors 48 and sockets 15 are on a second loop 62. The same two wires, V-minus 24 and V-plus 26, are used to power each circuit. Signal wire 28 is used with circuit 60 and a second signal wire 29 is used with circuit 62. An end-of-line device 16, 17 must be used with each circuit 60, 62 respectively. In a cross-zoned system one detector from each circuit 60, 62 must be in alarm condition for an alarm to be sounded and fire extinguishing agents to be activated and dispensed. Hence, using the three wire circuit 10 of the present invention, a two zone system can be implemented with power consuming detectors, alarm function and supervisory function with only four wires.

FIG. 6 illustrates diagrammatically the differential voltage levels which can be measured on a signal wire 28 at control panel 12, and the interpretations assigned to each range. The circuit 10 will operate on AC or DC current and requires no particular voltage level.

Many alternative components and means may be utilized in any specific implementation of this invention which is defined by the scope of the following claims.

We claim:

1. A three wire electrical circuit for supplying electrical power to active, power-consuming fire detection devices and returning supervisory and alarm signals to a control panel comprising in combination:

a control panel;

at least one active, power-consuming fire detection device;

one active, power-consuming end-of-line device;

a plurality of sockets capable of receiving each of said active detection devices and said end-of-line device;

three electrically conductive wires, each connected to a terminal at said control panel, two of which are connected in series to corresponding terminals on each of said sockets and then to corresponding terminals on said socket for receiving said end-of-line device;

a third wire being connected to two corresponding terminals on each of said sockets in interrupt segments from each of said sockets to the next serial socket;

a bridging plurality of reverse-biased diodes connecting to corresponding terminals on each of said sockets to connect the interrupt segments of said third wire;

a source of electrical power at said control panel the minus terminal of which is connected to the first of three wires; the plus-terminal of which is connected to the second of said wires;

said end-of-line device containing a switching device which bridges the first of said wires having a negative voltage to said third wire if it senses power on the first and second of said wires;

each of said detectors containing a shunting strap which bridges the first of said wires having a negative voltage to said third wire;

each of said detectors containing a normally open switch which closes upon detection of combustion to bridge said second wire having a positive voltage to said third wire to indicate an alarm condition at said control panel;

said reverse-biased diodes permitting a positive voltage to pass through the interrupt segments of said third wire and preventing a negative voltage to pass therethrough;

voltage measuring means at said control panel.

2. The circuit of claim 1 wherein said power supply is capable of furnishing 24 volts direct current at said control panel.

3. The circuit of claim 1 further including a signal lamp on each of said detectors connected in parallel with said detector to indicate a normal, power operative condition.

4. The circuit of claim 1 further including at a control site, a remote signal lamp corresponding to each of said detectors connected in parallel with said detector to indicated a normal, power operative condition.

5. The circuit of claim 1 further including an auxiliary relay mounted within said sockets connected in parallel with said detector to operate auxiliary devices during a normal power operative condition.

6. The circuit of claim 1 further including passive, non-power consuming detection devices having terminals corresponding to and capable of insertion in said socket.

7. A three wire detection circuit loop for a cross zoned detection circuit, each zone forming a part of interdependent alarm circuit comprising:

a control panel;

at least two active power-consuming detection devices;

at least two active end-of-line devices;

a plurality of sockets capable of receiving each said detection devices and said end-of-line devices;

two wires connected to said control panel and connected to corresponding terminals on said sockets receiving said detection devices and then to corresponding terminals on said receiving said end-of-line devices, each zone thereby sharing said two wires;

a third wire for each of said zones, said third wire, being a signal wire, defining an alarm zone and each of said zones having at least one active power consuming detection device, one power consuming end-of-line device and corresponding sockets;

said third wire being connected to said control panel and connected to two corresponding terminals on each of said sockets in interrupted segments from each of said sockets to the next serial socket in one of said alarm zones;

a bridging plurality of reverse-biased diodes connecting to corresponding terminals on each of said sockets to connect the interrupted segments of said signal wires;

a source of electrical power at said control panel, the minus terminal of which is connected to the first of said wires; the plus-terminal of which is connected to the second of said wires:

said end-of-line devices containing a switching device which bridges the first of said wires having a negative voltage to the corresponding signal wire if it senses power on the first and second of said wires;

each of said detectors containing a shunting strap which bridges the first of said wires having a negative voltage to said signal wire;

each of said detectors contacting a normally open switch which closes upon detection of combustion to bridge said second wire having a positive voltage to said signal wire to indicate an alarm condition at said control panel;

said reverse-biased diodes permitting a positive voltage to pass through the interrupt segments of said signal wire and preventing a negative voltage to pass therethrough; and at least two voltage measuring means, one for each of said zones; and said cross-zoned circuit capable of an alarm signal when one detector from each zone is in an alarm condition.

8. The circuit of claim 7 further including:

an auxiliary relay mounted within said sockets connected in parallel with said detector to operate auxiliary devices;

a remote signal lamp at a control site corresponding to and connected in parallel with each of said detectors to indicate a normal power operative condition.

9. The circuit of claim 7 further including passive, non-power consuming detection devices capable of insertion into said sockets and corresponding terminals and capable of activating said signal circuit alarm notification.

* * * * *